United States Patent [19]

Sato

[11] 4,055,118

[45] Oct. 25, 1977

[54] PRINTING HEAD FOR PORTABLE LABELING MACHINE, OR THE LIKE

[75] Inventor: Yo Sato, Tokyo, Japan

[73] Assignee: Kabushiki Kaisha Sato Kenkyusho, Tokyo, Japan

[21] Appl. No.: 658,491

[22] Filed: Feb. 17, 1976

[30] Foreign Application Priority Data

Feb. 17, 1975 Japan ..... 50-020758[U]

[51] Int. Cl.[2] ..... B41J 1/20

[52] U.S. Cl. ..... 101/110; 101/111

[58] Field of Search ..... 101/109, 110, 111, 45, 101/95, 99, 106, 88, 107

[56] References Cited

U.S. PATENT DOCUMENTS

| | | | |
|---|---|---|---|
| 3,269,306 | 8/1966 | Smilgys | 101/110 |
| 3,587,457 | 6/1971 | Morris | 101/110 |
| 3,741,114 | 6/1973 | Maul et al. | 101/110 |
| 3,796,152 | 3/1974 | Finke et al. | 101/111 |
| 3,828,664 | 8/1974 | Dikoff | 101/110 |
| 3,908,543 | 9/1975 | Wirth | 101/110 |
| 3,968,745 | 7/1976 | Hamisch | 101/111 |

*Primary Examiner*—Edward M. Coven

*Attorney, Agent, or Firm*—Ostrolenk, Faber, Gerb & Soffen

[57] ABSTRACT

An improved rotary printing head for being mounted on a portable labeling machine or the like comprising a plurality of side-by-side indexing wheels all having polygonal shape; the peripheral sides of the polygonal indexing wheels are either provided with types or they support stamp belts having types thereon; the indexing wheels are supported at their axes by a fixed positioning member which is provided with a respective, elastic engagement piece for each indexing wheel, and the engagement pieces each have index wheel engagement projections; particular desired types on the indexing wheels can be accurately positioned by rotating the indexing wheel and then bringing the engagement projections into engagement with indexing grooves formed on the inside surface of the indexing wheels.

9 Claims, 8 Drawing Figures

1
2
2'
3
4
5
6
7
8
9
10
11
12
13
14
15
16
17
18
19
20
22
23
24
26
27
29

PRINTING HEAD FOR PORTABLE LABELING MACHINE, OR THE LIKE

BACKGROUND OF THE INVENTION AND DESCRIPTION OF THE PRIOR ART

This invention relates to a rotary printing head capable of being mounted on a portable labeling machine, a desk-type label printing machine, or the like.

In conventional rotary printing heads, rotation wheels directly or indirectly engage respective printing type support rings. Rotation of the rotation wheels selects and positions for printing particular ones of types that are formed on the outer surfaces of the type rings.

In prior art type positioning mechanisms, the above-mentioned type support rings are rotatably carried by a supporting shaft. A plurality of small blind holes are formed in the outer surface of the supporting shaft. Minute coil springs, with steel balls atop them, are fitted into the blind holes. Correspondingly positioned recesses are formed in the inside surfaces of the type rings. These are engaged by the spring-actuated steel balls on the supporting shaft.

However, the assembly of the above described mechanisms is difficult because many minute parts must be handled. The production cost is thus high. In addition, the coil springs and steel balls are liable to be lost during the assembly or later disassembly. Further owing to its structure, it is difficult to form a plurality of the above described ring and shaft engagement arrangements in every type ring. Usually, therefore, only one engaging portion is formed in each type ring. This unfortunately causes the engagement between the above-mentioned recesses and steel balls to be comparatively unstable. Accurate positioning of the type rings is not obtained.

In addition, when an excessive quantity of ink is supplied to the type faces, it interferes with the rotation of the type rings. A plurality of the type rings are held on their supporting shaft in side-by-side relation. The excess ink enters into the gaps between adjacent type rings and into the above described recesses inside the type rings. The ink erodes the above-mentioned coil springs and steel balls that are secured between the type rings and the supporting shaft.

SUMMARY OF THE INVENTION

The primary object of the present invention is to provide a printing head of the type described in which accurate positioning of desired types can be attained.

A further object of the present invention is to provide such a printing head, the assembly and disassembly of which can be easily performed and the production cost of which is reduced.

Another object of the present invention is to provide such a printing head having a positioning member which is free from the corrosion caused by entry of printing ink into the gaps between type rings.

To realize the above objects, the printing head of the present invention includes at least one but more usually a plurality of indexing wheels which are arrayed side-by-side and are supported for rotation by a fixed positioning member. The positioning member carries and preferably has integrally connected with it at least one elastic engagement piece for each indexing wheel. Each engagement piece carries and also has integrally connected with it a respective detent means, preferably comprising an external engagement projection. These detent means engage with one of the respective detent means, usually comprising grooves, formed on the circular internal wall surface of the respective indexing wheel. Such engagement enables accurate positioning of desired printing type.

In one embodiment of the present invention, the positioning member comprises a plurality of supporting plates, the same in number as the indexing wheels, arrayed side-by-side and integrally attached together and/or to a common positioning member support and forming the positioning member. Each supporting plate is provided with respective elastic engagement pieces.

In another embodiment of the present invention, the positioning member comprises a support portion made of a single solid piece, and all of the elastic engagement pieces are attached thereto. Each engagement piece is positioned at its respective indexing wheel.

BRIEF DESCRIPTION OF THE DRAWINGS

The foregoing and other objects and features of the present invention will become apparent from the following description taken in connection with the accompanying drawings, in which.

DETAILED DESCRIPTION OF THE PREFERRED EMBODIMENTS

Figures 1, 2:
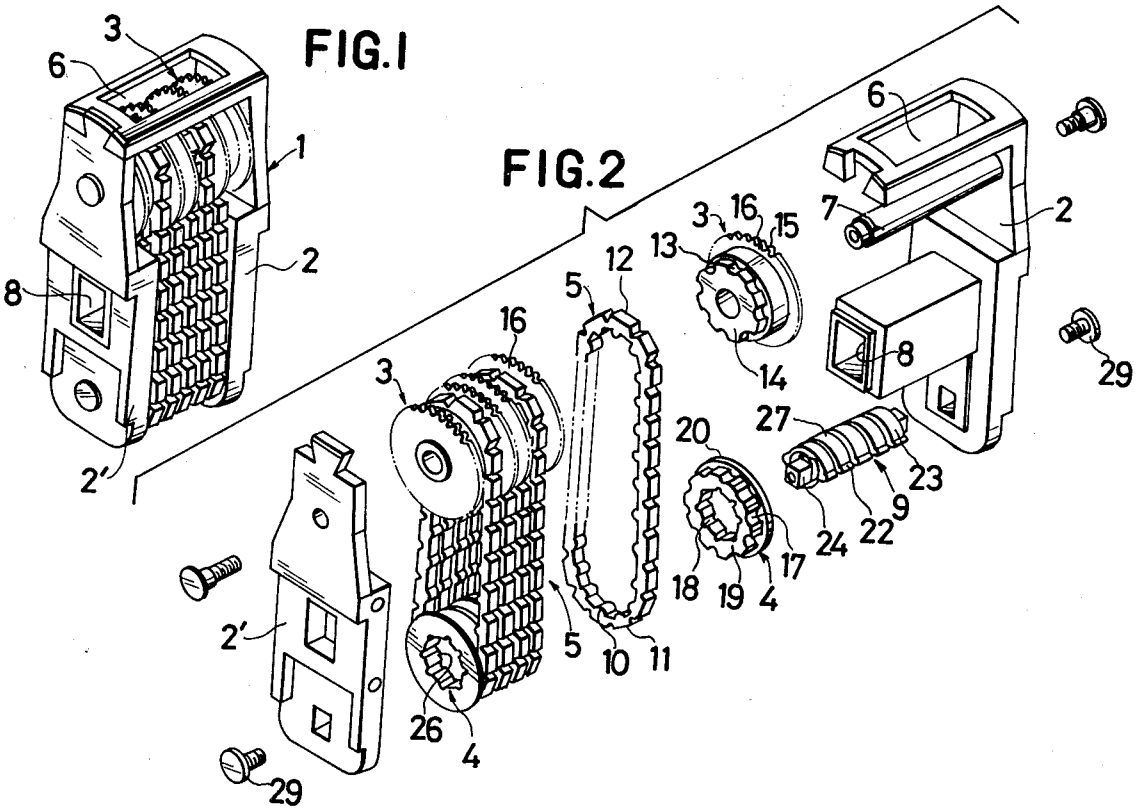
FIG. 1 is a perspective view of a first embodiment of the printing head.
FIG. 2 is an exploded perspective view of the first embodiment of printing head.

Referring to FIGS.1 to 6, the first embodiment of the present invention is now described.

The printing head 1 comprises a plurality of upper wheels 3 which are disposed in aligned side-by-side relationship between the upper portions of a pair of frames 2 and 2', indexing wheels 4, which are disposed in aligned, side-by-side relationship between the lower portions of the frames 2 and 2', and several rows of stamp belts or print type belts 5 that pass around and are carried by the upper wheels 3 and the indexing wheels 4.

The top end of the frame 2 is provided with a sight window 6 that extends to and meets frame 2'. Attached to frame 2 and extending beneath sight window 6 to frame 2' is a wheel shaft 7 which carries the upper wheels 3. Square shaped cross section tube 8 is attached to the middle portion of frame 2 and extends to frame 2'. A printing type belt positioning member 9 is also attached to the frame 2 below the square tube 8 and it also extends to frame 2'. The positioning member 9 carries the indexing wheels 4 and sets wheels 4 at their accurate positions when the wheels 4 are turned.

Each stamp belt 5 is an endless flexible belt. Each stamp belt 5 has a plurality of detent means, i.e. projections 10, on its inner surface and spaced at regular intervals. The outer surface of each stamp belt 5 carries near its lower end a series of types 11 for printing indicia and also carries near its upper end a series of indicating indicia 12 corresponding to the types 11. The types 11 and indicia 12 are arranged in sequence and are so spaced that for each type 11, as it is in the print position at the bottom of the printing head 1, the corresponding indicium is visible through sight window 6.

Figure 3:
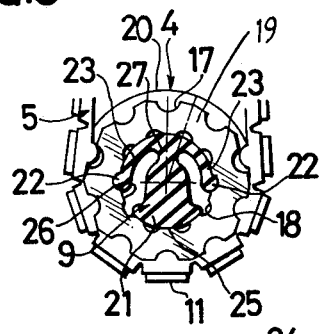
FIG. 3 is a cross-sectional side elevational view showing the relationship between a positioning member and an indexing wheel carrying a stamp or type belt.
Figure 5:
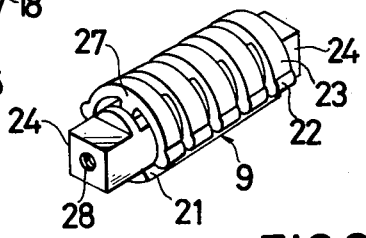
FIG. 5 is a perspective view of the positioning member used in the printing head of the first embodiment.

Each upper wheel 3 comprises a stamp belt carrier or idler wheel 14. On one side of wheel 14 is a rotation wheel 16 by which wheel 14 and the corresponding below described indexing wheel 4 are rotated. Wheel 16 has a diameter larger than that of the carrier wheel 14. As shown in FIG. 3, the carrier wheel 14 is a regular polygon. Formed at the center of each side of the polygon is a groove 13 which is brought into engagement with a respective internal projection 10 of the respective stamp belt 5 when a belt 5 is placed on carrier wheel 14. Projections 10 are spaced to cooperate with grooves 13. The rotation wheels 16 are provided with non-slip notches 15 on their peripheries, which enables engagement with appropriate means, even a person's finger, for rotating upper wheels 3.

Each indexing wheel 4 comprises a stamp belt carrier wheel 19 on one side of wheel 14 and a circular plate 20 having a diameter larger than that of the carrier wheel 19. Circular plate 20 is integrally attached to one side of the carrier wheel 19 to prevent transverse movement of the stamp belt 5 when it is guided. Carrier wheel 19 is also a regular polygon and its sides are preferably the length of the sides of wheel 14. A groove 17 is formed at the center of each side of the polygon of carrier wheel 19 so as to receive the projections 10 of a respective stamp belt 5. The spacing of grooves 17 is preferably the same as the spacing of grooves 13. Detent means in the form of engagement grooves 18 are formed in the inside surface 26 of carrier wheel 19. Each groove 18 is positioned along the line between the center of the polygonal carrier wheel 19 and the junction between adjacent sides of polygonal carrier wheel 19.

The positioning member 9 that supports the indexing wheels 4 includes a bearing portion 21 having a bearing surface 25 on its lower side which is arcuate in cross-section. The bearing surface is inside the indexing wheel on the side of the indexing wheel where the types are in printing position. The bearing surface 25 of the bearing portion 21 also receives the upward pressure caused when the type is pressed to a paper surface during the printing operation.

The positioning member 9 is inserted through the indexing wheels 4 with the bearing surfaces 25 being in contact with the inside surfaces 26 of the indexing wheels 4. The positioning member 9 comprises a plurality of engaging members 27 that are generally T-shaped in cross section (FIG. 3). There are the same number of engaging members 27 as indexing wheels 4. Engaging members 27 are integrally formed and attached at regular intervals corresponding to the placement of the indexing wheels 4 on the upper side of the bearing portion 21 of the positioning member 9. Each engaging member 27 includes as its cross bar at least one and preferably a pair of elastic engagement pieces 23 which are thinner in the radial direction than the radial thickness of each indexing wheel 4 and which are bent so as to engage with the inside surface 26 of the indexing wheel 4. Further, on the outer tip ends of the elastic engagement pieces 23, detent means, i.e. projections 22, are formed. These are biased into engagement with the engagement grooves 18 of the indexing wheel 4. The positioning member 9 is further provided with polygonally shaped supporting blocks 24 on both ends of the bearing portion 21. Screw holes 28 are formed on the outer end faces of the supporting blocks 24. The blocks 24 are attached into correspondingly shaped openings in the lower portions of the frames 2 and 2' with set screws 29. The shapes of the receiving openings in frames 2, 2' prevents rotation of positioning member 9.

Projections 22 index into (FIG. 3) and out of (FIG. 4) grooves 18 as wheels 19 rotate and they serve to properly position types 11 and indicia 12.

The second embodiment of the present invention is described with reference to FIGS. 7 and 8. The principal difference between the first and second embodiments is that the latter uses no stamp belts 5 but has the upper and lower wheels in direct engagement. Elements corresponding to those in the first embodiment are correspondingly numbered with reference numerals raised by 100.

The upper wheel 103 integrally comprises a carrier wheel 114 and a rotation wheel 116, and both of these are rotatably supported by a wheel shaft 107. Indicia 112 are formed on the peripheral surface of the carrier wheel 114. Non-slip notches 115 are formed on the periphery of the rotation wheel 116.

Lower indexing wheel 104 is integrally formed and comprises a carrier wheel 119 and a gear 120. The carrier wheel 119 is a regular polygon and each side of the polygon is provided with a type 111. Engagement grooves 118 are formed in the inside surface 126 of carrier wheel 119. The groove 118 is along the line between the center of the carrier wheel 119 and the junction between adjacent sides of the carrier wheel 119.

One side of the carrier wheel 119 is provided with a gear 120 which has a diameter smaller than that of the carrier wheel 119 and which is in engagement with the abovementioned non-slip notches 115 on rotation wheel 116. By this means, rotation of wheel 116 in one direction rotates wheel 119 in the opposite direction. (This is to be contrasted with the same rotation direction obtained with stamp belts 5.) The types 111 and indicia 112 are coordinated as to orientation and sequence so that the indicium viewable in the sight window parallels the type in the print position.

The carrier wheel 119 is supported by a positioning member 109, which is the same as the positioning member 9 of the first embodiment. Positioning member 109 includes a bearing portion 121 formed in the lower part of the positioning member 109 and includes a plurality of pairs of elastic engagement pieces 123 formed in the upper part of the positioning member 109. The elastic engagement pieces 123 are bent so as to extend along the inside surface 126 of the indexing wheel 104. On the outer tip ends of the engagement pieces 123, engagement projections 122 are integrally formed. These are biased into engagement with the grooves 118 in the inside surface 126 of the indexing wheel 104.

The wheel shaft 107 carrying the upper wheels 103 and the positioning member 109 carrying the indexing wheels 104 are attached at both their ends to the frames (not shown but equivalent to frames 2, 2') of the printing head in the same manner as the first embodiment.

The operation of the above printing heads is now described.

Figure 4:
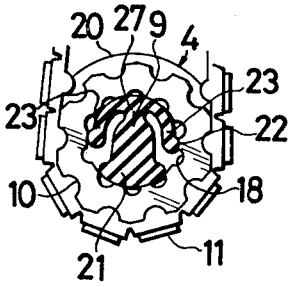
FIG. 4 is the same view as FIG. 3 where the indexing wheel is slightly rotated.
Figure 6:
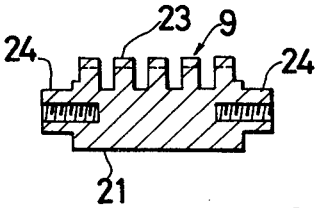
FIG. 6 is a longitudinal cross-sectional view of the positioning member shown in FIG. 5.

The type 11 on the stamp belt 5 that is to be selected is moved by rotating the respective rotation wheel 116, while watching the corresponding indicium 12 through the sight window 6. The indexing wheel 4 is rotated around the positioning member 9 with the movement of the stamp belt 5. The elastic pieces 23 of the positioning member 9, resting on the inside surface 26 of the indexing wheel 4, are forced to bend inward. Initial rotation of wheel 4 causes the projections 22 of the elastic pieces 23 to be disengaged from the grooves 18, as shown in FIG. 4. When the indexing wheel 4 is turned further, the projections 22 of the elastic pieces 23 engage into the next grooves 18 by their own elasticity, as shown in FIG. 3. Therefore, the indexing wheel 4 stops at the correct position and it does not move again unless the rotation wheel 16 is rotated again.

Figure 7:
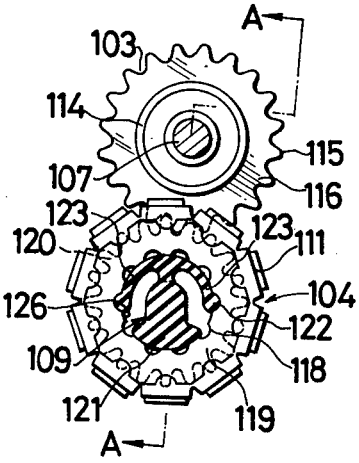
FIG. 7 is a cross-sectional side elevation view of a second embodiment of a printing head showing the relationship between an upper rotation wheel and an indexing wheel.
Figure 8:
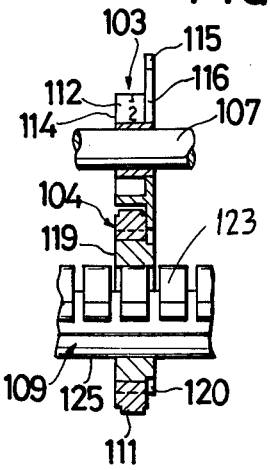
FIG. 8 is a cross sectional view of the second embodiment taken along the line and in the direction A —A in FIG. 7.

The operation of the second embodiment shown in FIGS. 7 and 8 is similar to the operation of the first embodiment, except that the belts 5 transmit rotation in one case, while the interengagement of gears causes rotation in the second case.

Further, in the present invention, the whole of the positioning member or at least the elastic engagement pieces thereof are made of flexible and corrosion resistant materials, such as plastic or synthetic rubber, so as to prevent these members from corroding due to excessive ink.

From the above detailed disclosure, the operation and advantages of the present invention may be understood. These characteristic features are now summarized:

1. The inside surface of the indexing wheel is provided with engagement grooves. The positioning member is provided with elastic engagement pieces carrying projections to be engaged with the engagement grooves. This enables positioning of a desired type to be performed accurately. Especially when a pair of the elastic engagement pieces extending in opposite directions from a central support around the interior of the indexing wheel are used as a unitary combination, the engagement of the engagement pieces with the engagement grooves becomes very stable.

2. The assembly and disassembly of the printing head can be carried out easily and quickly since the printing head of the invention is provided with a unitary positioning member.

3. The production cost of the printing head can be reduced.

4. Even when the ink supplied to the type faces enters the gaps between type rings or indexing wheels, the printing head is not harmed by corrosion of the positioning member.

Although the present invention has been described in connection with preferred embodiments thereof, many variations and modifications will now become apparent to those skilled in the art. It is preferred, therefore, that the present invention be limited not by the specific disclosure herein, but only by the appended claims.

I claim:

1. A printing head for selecting and imprinting selected indicia, comprising:

at least one rotatable indexing wheel; said indexing wheel having an external periphery; said indexing wheel having a central axial opening passing therethrough; said central opening being defined by an internal annular wall of said indexing wheel;

first detent means spaced at predetermined intervals around said internal wall;

an internal positioning member; means supporting said positioning member against rotation along with rotation of said indexing wheel; said positioning member passing through said central opening; said indexing wheel being rotatable with respect to said positioning member; said positioning member further comprising two engagement pieces for said indexing wheel; said positioning member also comprising an engaging member in engagement with said internal wall and to which said engagement pieces are integrally attached; said engagement pieces extending in opposite directions from their said engaging member around said internal wall; said engagement pieces being held in fixed position on said positioning member engaging member and being held in engagement with said indexing wheel internal wall; each said engagement piece comprising a resilient arm bent into shape and positioned to engage the respective said internal wall along the length of said engagement piece arm;

at least one second detent means attached to each said engagement piece and engageable with each said first detent means as said indexing wheel and its said first detent means are rotated past said second detent means; said second detent means being so spaced apart and placed on their respective said engagement piece that both said second detent means alway simultaneously engage a respective said first detent means;

a plurality of printing types; means for holding said printing types to the exterior of said indexing wheel; said indexing wheel having a print position thereon at which a said type is in position to imprint; the length of each said type around said indexing wheel being related to the interval between two said first detent means such that rotation of said indexing wheel from engagement between one said first detent means and said second detent means to engagement between another said first detent means and said second detent means serves to remove one said type from said print position on said index wheel periphery and moves another said type to said print position on said indexing wheel;

said positioning member supporting a bearing portion having a bearing surface that engages said internal wall at the same side of said indexing wheel as said print position for said types; said engaging member engaging said internal wall of said indexing wheel at a location thereon opposed to the side thereof of said print position;

said positioning member, said engagement pieces and said engaging member for said engagement pieces all being an integral, single, solid piece inside said indexing wheel central opening;

rotating means for causing rotation of said indexing wheel.

2. The printing head of claim 1, wherein said types are of equal length measured in the direction around said indexing wheel, said intervals between said first detent means are equal and rotational movement of said indexing wheel from engagement of said second detent means with one said first detent means to engagment of said second detent means with the adjacent said first detent means shifts the next said type in sequence to the print position.

3. The printing head of claim 2, wherein each said first detent means comprises a groove and said second detent means comprises an engagement projection adapted to fit into each said first detent means groove.

4. The printing head of claim 1, wherein there are a plurality of said indexing wheels arranged side-by-side; said positioning member extending through all of said indexing wheels and across the entire array thereof;

respective engagement pieces being inside each said indexing wheel central opening and being fixedly supported on said positioning member; each said indexing wheel being individually rotatable around said positioning member, and there are said rotating means for rotating each said indexing wheel individually.

5. The printing head of claim 4, wherein each said indexing wheel is a polygon and each said type is on a side of said polygonal indexing wheel.

6. The printing head of claim 4, wherein said types for each said indexing wheel are carried on a respective stamp belt, and each said stamp belt passes around and is engaged by said periphery of said indexing wheel;

idler means for supporting each said stamp belt and for holding same securely against said periphery of its said indexing wheel.

7. The printing head of claim 4, further comprising type indicator means connected to each said indexing wheel and movable therewith for indicating which said type is in the print position of each said indexing wheel.

8. The printing head of claim 1, wherein each said engagement piece is made of a corrosion resistant material.

9. The printing head of claim 1, wherein said rotating means for causing rotation of said indexing wheel comprises an operating wheel for operating said indexing wheel; said operating wheel comprising a carrier wheel carrying indicia thereon and a rotation wheel attached to said carrier wheel; a shaft about which said operating wheel is rotatable;

said indexing wheel comprising a second carrier wheel for carrying said types thereon and a gear attached to said second carrier wheel and in engagement with said rotation wheel of said operating wheel for rotating said indexing wheel as said rotation wheel is rotated;

said indicia on said carrier wheel being so arranged and placed so as to indicate at one indication position around said carrier wheel the said type that is then at said print position of said indexing wheel.

* * * * *